US006104144A

United States Patent [19]

Yoneya et al.

[11] Patent Number: 6,104,144

[45] Date of Patent: Aug. 15, 2000

[54] CHARGING CIRCUIT FOR STROBOSCOPE

[75] Inventors: Takayuki Yoneya, Machida; Keizo Sekido, Hadano, both of Japan

[73] Assignee: Stanley Electric Co., Ltd., Tokyo, Japan

[21] Appl. No.: 09/033,411

[22] Filed: Mar. 2, 1998

[30] Foreign Application Priority Data

Mar. 4, 1997 [JP] Japan ..... 9-049190

[51] Int. Cl.[7] ..... H04B 37/00

[52] U.S. Cl. ..... 315/241 R; 315/241 P; 396/205

[58] Field of Search ..... 315/241 P, 241 S, 315/241 R; 396/205, 206

[56] References Cited

U.S. PATENT DOCUMENTS 4,075,536 2/1978 Stevens ..... 315/241 P
4,951,081 8/1990 Hosomizu et al. .
5,159,381 10/1992 Harrison .
5,661,372 8/1997 Ishimaru et al. .

*Primary Examiner*—David Vu
*Attorney, Agent, or Firm*—James Creighton Wray; Meera P. Narasimhan

[57] ABSTRACT

A conventional stroboscope circuit in use for a film camera has encountered with problems that charging of a main capacitor is incapable when other functions of the camera are operated and that a charging operation is delayed. To solve aforesaid problems, the present invention is to charge the capacitor C1 for a flashlight illumination by a use of a stroboscope charging circuit 1. During that, a usual charging operation is performed by feeding a higher current which flows through a transistor Q1, in a manner wherein a control signal CTL is switched to an H (a high) level status. When the other functions of the camera are operated on the contrary, the charging is performed by feeding a lower current which flows through a resistor R1, wherein the control signal CTL is switched to an L (a low) level status.

3 Claims, 2 Drawing Sheets

CHARGING CIRCUIT FOR STROBOSCOPE

BACKGROUND OF THE INVENTION

1. Field of the Invention

The present invention relates mainly to a stroboscope circuit and, more particularly, to those having a charging capability of a main capacitor which discharges an electronic discharge lamp for stroboscopic flashlight illuminations during photographing by use of a film camera.

2. Brief Description of the Prior Art

FIG. 4 is a view showing main parts of a conventional stroboscope circuit. In the figure, a numerical character 1 stands for a stroboscope charging circuit charging up a capacitor C1 in use for flashlight illuminations, 3 stands for an input terminal VB receiving a synchronous signal (a timing signal) and 5 stands for a ground (GND) terminal.

When the synchronous signal VB (a voltage signal) is applied to aforesaid circuit, the stroboscope charging circuit 1 operates to supply a charging current to the capacitor C1 in use for flashlight illumination. A numerical value of this charging current is set up to be a certain specified value, for instance, some amperes (referred to as "A" hereinafter) to complete quickly a charge up operation of the capacitor C1.

FIG. 5 is a graph showing a time dependence of an input current supplied to aforesaid capacitor C1 in a conventional circuit. Herein an abscissa represents an elapsing time while an ordinate represents the input current I supplied to the capacitor C1. Namely, FIG. 5 indicates a waveform of the input current supplied to the capacitor C1 in the conventional charging circuit. It is clarified from FIG. 5 that the input current supplied to capacitor C1 is constant and saturates at a value of some A.

Because the charging current supplied to the capacitor has been specified at a higher value up to now to finish the charging operation earlier in the conventional stroboscope circuit as mentioned above, they have encountered with some problems wherein any other operations such as processing an exposure data concerning photographing, displaying a photographic image onto a liquid crystal device (referred to as "LCD" hereinafter) etc. cannot be performed during charging the capacitor.

Accordingly, the stroboscopic tubes have sometimes been subjected to a flashlight operation even at status wherein charging of the driving capacitor has not been completed yet.

SUMMARY OF THE INVENTION

The present invention is carried out in a circumstance mentioned above. To solve aforesaid problems, the present invention provide a stroboscope circuit, wherein a capacitor supplies a driving current to a stroboscopic tube, with a charging circuit for charging the capacitor as well as with a switching means thereby to switch the charging current between at least two current levels.

Another object of the present invention is to constitute the switching means of the charging current mentioned above so as to switch the charging current level between an ordinary charging mode and a low current charging mode in latter of which the charging operation does not have any ill effect to any other camera functions.

DETAILED DESCRIPTION OF THE PREFERRED EMBODIMENTS

Hereinafter are described the preferred modes for carrying out the present invention into practice with reference to the drawings. The best mode will also be clarified corresponding to the preferred embodiments.

Figure 1:
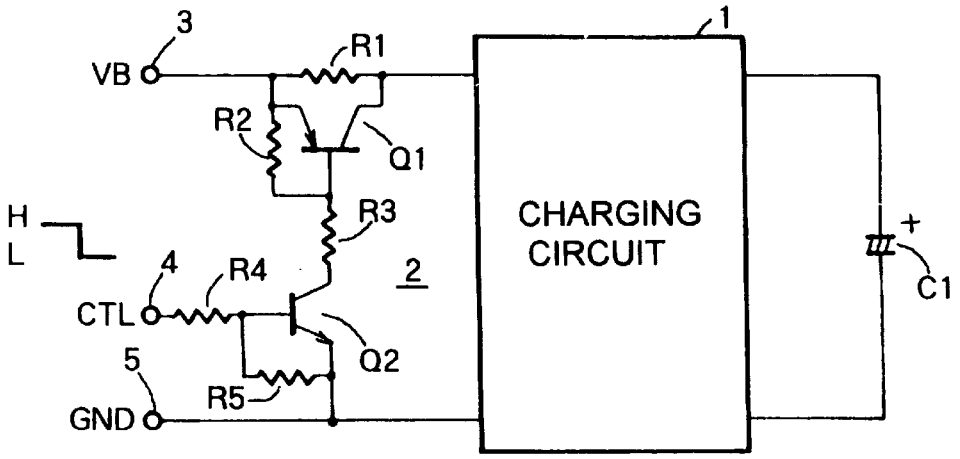
FIG. 1 is a circuit diagram showing one embodiment according to the present invention.
Figure 4:
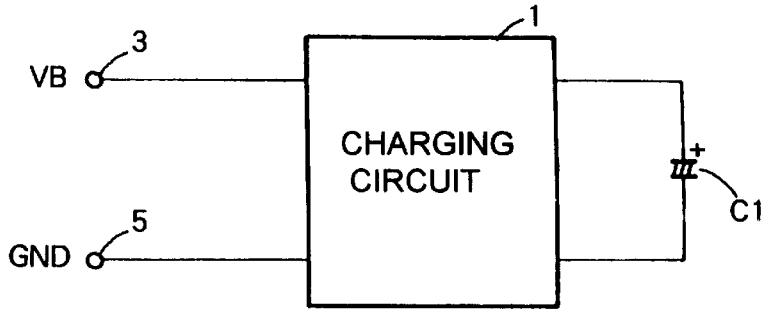
FIG.4 (PRIOR ART)
FIG. 4 (PRIOR ART) is another circuit diagram showing a conventional example.
Figure 5:
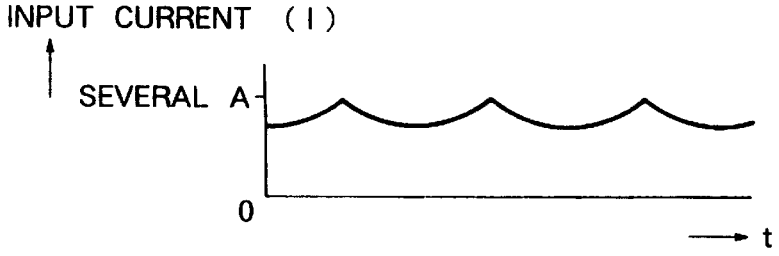
FIG.5 (PRIOR ART)
FIG. 5 (PRIOR ART) is still another graph showing the waveform of the input current supplied to the capacitor shown in FIG. 4.

FIG. 1 is a circuit diagram showing main parts of a stroboscope circuit according to the present invention, wherein the same numerical characters as in FIG. 4 represent the same constituents as shown in FIG. 4.

In FIG. 1, 1 stands for a charging circuit which charges the capacitor C1 in use for flashlight illumination with electricity. The charged capacitor C1 supplies a driving current to a sort of an electronic flash lamp called a stroboscope tube which is not shown in the figure. Herein 2 stands for a switching means therewith to switch a charging current supplied to the capacitor C1 between an ordinary charging mode which completes quickly a charging operation and a low current charging mode which does not have any ill effects to the other camera functions.

Aforesaid switching means 2 is composed of a resistor R1 which is inserted in series with respect to a charging line, a pnp-type transistor Q1 which is connected in parallel with respect to aforesaid resistor R1 and an npn-type transistor Q2 of which collector electrode is interconnected to a base electrode of the transistor Q1. Resistors denoted from R2 to R5 limit currents to certain specified values.

On the other hand, 3 of FIG. 1 stands for an input terminal electrode for receiving a synchronous signal (a timing signal) VB, which is interconnected to an emitter electrode of the transistor Q1 as well as to an emitter end of the resistor R1. A numeral 4 stands for an input terminal electrode receiving a switching control signal CTL which is interconnected through the resistor R4 to the base electrode of the transistor Q2. A numeral 5 stands for a ground (GND) terminal.

If a synchronous voltage signal VB is applied similarly in FIG. 4, to the stroboscope circuit constituted mentioned above, the stroboscope charging circuit 1 begins to operate to charge the capacitor C1 in use for flashlight illumination.

When the control signal CTL is located at an H (a high level) status, the transistor Q1 turns on because the transistor Q2 turns on. Consequently, the capacitor C1 is charged up by an ordinary current which flows through the transistor Q1. When the control signal CTL is located at an L (a low level) status on the contrary, the transistor Q1 turns off because the transistor Q2 is turned off. Accordingly, the capacitor C1 is charged up by a low current which flows through the resistor R1.

Figure 2:
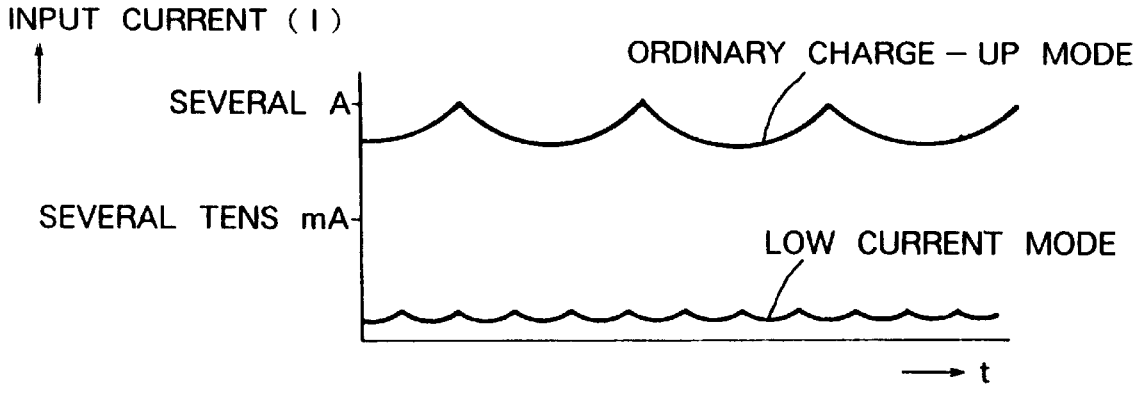
FIG. 2 is a graph showing waveforms of input currents supplied to a capacitor shown in FIG. 1.

FIG. 2 shows a time dependence of the input currents supplied to the capacitor C1 according to the present invention. An abscissa of a graph shown in FIG. 2 indicates an elapsing time while an ordinate of the graph indicates numeric values of the input currents supplied. Accordingly, FIG. 2 exhibits waveforms of the charging currents. It is clarified from FIG. 2 that the capacitor C1 is charged up at a higher current such as some A, at the ordinary charging mode while the capacitor C1 is charged up at a lower current such as some tens milliamperes (referred to as "mA" herein after) at the low current mode, which does not have any ill effect to the other camera functions.

Figure 3:
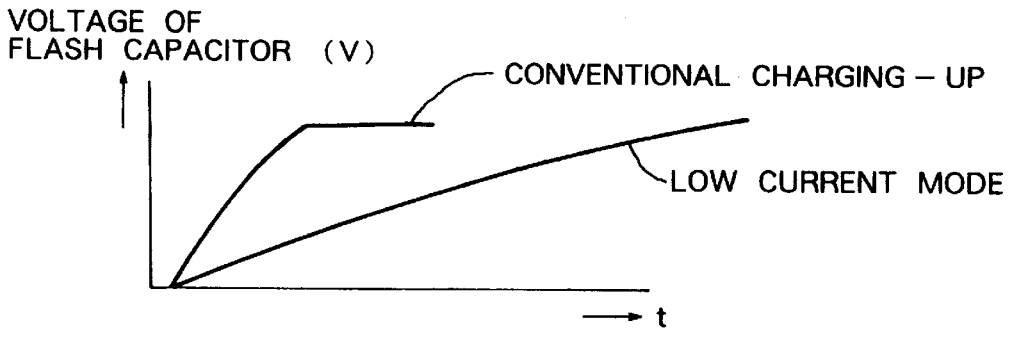
FIG. 3 is another graph showing voltage waveforms of the capacitor 1 shown in FIG. 1.

On the other hand, FIG. 3 is a graph showing a time dependence of a potential of the capacitor C1 according to the present invention. Consequently, FIG. 3 is voltage waveforms of the flashlight capacitor C1 during charging. It is clarified from FIG. 3 that the ordinary current mode performs a quick charging while the low current mode takes a long term till finishing a charging operation.

As mentioned above, the present invention provides the charging current supplied to the capacitor C1 with at least two current levels composed of the ordinary current mode and the low current mode, latter of which does not have any ill effects to the other camera functions. One can maintain the stroboscope circuit always at a charging up status by switching the charging currents between two modes if necessary. This provides generally a stroboscope circuit having a quick charging operation.

Namely, to charge the stroboscope circuit in the lower current mode when the film camera performs the other camera functions makes it possible to maintain the stroboscope always at a charged up status, which realizes a quick charging operation when it is used.

Although the charging modes are described to be divided into at least two modes as mentioned above, it may preferably be divided into more than two modes such as three modes to enable a quicker charging operation.

The switching of the charging mode from a high current level to a low current level may be done by either manually or by automatedly by sensing operations of the camera functions.

Because a plurality of the charging modes in which charging currents differ from each other are provided according to the present invention as described above, the stroboscope circuit is capable of quickly charging up the main capacitor even during the other camera functions being performed.

What is claimed is:

1. A stroboscope circuit which supplies a driving current from a capacitor to a stroboscopic tube, comprises:

a charging circuit which charges said capacitor; and a switching means which switches a charging period of said capacitor between at least two current levels, wherein said switching means is composed of a resistor which is interconnected in series with respect to a charging line of said capacitor, a pnp-type transistor which is interconnected in parallel with respect to said resistor and an npn-type transistor of which collector electrode is interconnected to a base electrode of said pnp-type transistor.

2. The stroboscope circuit according to claim 1, wherein said switching means is to switch said charging current between an ordinary time level and an earlier time level, latter of which maintains good operation with respect to other functions of a film camera.

3. The stroboscope according to claim 2, wherein the pnp-type transistor is turned on when an earlier time level is needed.

* * * * *